US005273319A

United States Patent [19]

Lee

[11] Patent Number: 5,273,319

[45] Date of Patent: Dec. 28, 1993

[54] BOOK COVER HINGE ASSEMBLY

[76] Inventor: Ming D. Lee, No.1, Lane 311, Tong Wan Shou Road, Kui-Shan, Taoyuan Hsien, Taiwan

[21] Appl. No.: 9,219

[22] Filed: Jan. 26, 1993

[51] Int. Cl.[5] ..... B42D 3/00

[52] U.S. Cl. ..... 281/29; 281/19.1; 281/21.1; 402/76

[58] Field of Search ..... 281/15.1, 21.1, 29, 281/36, 14.1, 28; 402/73, 76, 77

[56] References Cited

U.S. PATENT DOCUMENTS 3,046,932 7/1962 Rodrigue ..... 281/29 X
4,828,421 5/1989 Arakaki ..... 281/29 X
5,067,748 11/1991 Wernquest ..... 281/29 X

FOREIGN PATENT DOCUMENTS 206148 4/1924 United Kingdom ..... 402/77

*Primary Examiner*—Mark Rosenbaum
*Assistant Examiner*—Willmon Fridie, Jr.
*Attorney, Agent, or Firm*—Bacon & Thomas

[57] ABSTRACT

A book cover hinge assembly is disclosed having two end connectors respectively fastened to two opposite open ends of an elongated casing to hold two opposite book covers, each end connector having two pins bilaterally disposed in the longitudinal direction and respectively inserted in pivot holes on the book covers, one end connector having a pen hole in line with a storage space defined within a channel plate inside the casing for inserting a pen.

2 Claims, 5 Drawing Sheets

BOOK COVER HINGE ASSEMBLY

BACKGROUND OF THE INVENTION

The present invention relates to hinges, and more particularly relates to a book cover hinge assembly for connecting the front cover of a book or the like to its back cover.

FIG. 1 illustrates a book cover hinge assembly according to the prior art, which is generally comprised of a casing 11 with hooks 111, a clip holder 12 with hook holes 121. The hooks 111 on the casing 11 are respective hooked in the hook holes 121 on the clip holder 12, and therefore the clip holder 12 is fastened to the casing 11. The clip holder 12 further comprises two opposite pairs of knuckles 122, into which pivot pins 13 are respectively inserted and partly engaged into knuckles 31 on the book covers 3 to be fastened. The knuckle 31 of each book cover 3 has gaps 32 on two opposite ends thereof, which allow the knuckle 31 to be expanded as respective pivot pins 13 are inserted. One disadvantage of this structure of book cover hinge assembly is that the pivot pins 13 may easily disconnect from the knuckles 122,31. Another disadvantage of this structure of book cover hinge assembly is that the casing 11 and the clip holder 12 are made for fastening book covers of a specific size. Therefore, different casings 11 and clip holders 12 must be used for fastening book covers of different sizes.

SUMMARY OF THE INVENTION

The main object of the present invention is to eliminate the aforesaid disadvantages. Another object of the present invention is to reduce the manufacturing cost of book cover hinge assemblies. According to the preferred embodiment of the present invention, the book cover hinge assembly comprises two end connectors respectively fastened to two opposite open ends of an elongated casing through plug joints to hold two opposite book covers. Each end connector has two pins bilaterally disposed in the longitudinal direction and respectively inserted in pivot holes on the book covers. One end connector has a pen hole in line with a storage space defined within a channel plate inside the casing for inserting a pen. Cotter pins are respectively inserted into holes on the casing and the end connectors to fasten a loose-leaf clip to the casing.

DETAILED DESCRIPTION OF THE PREFERRED EMBODIMENT

Figure 1:
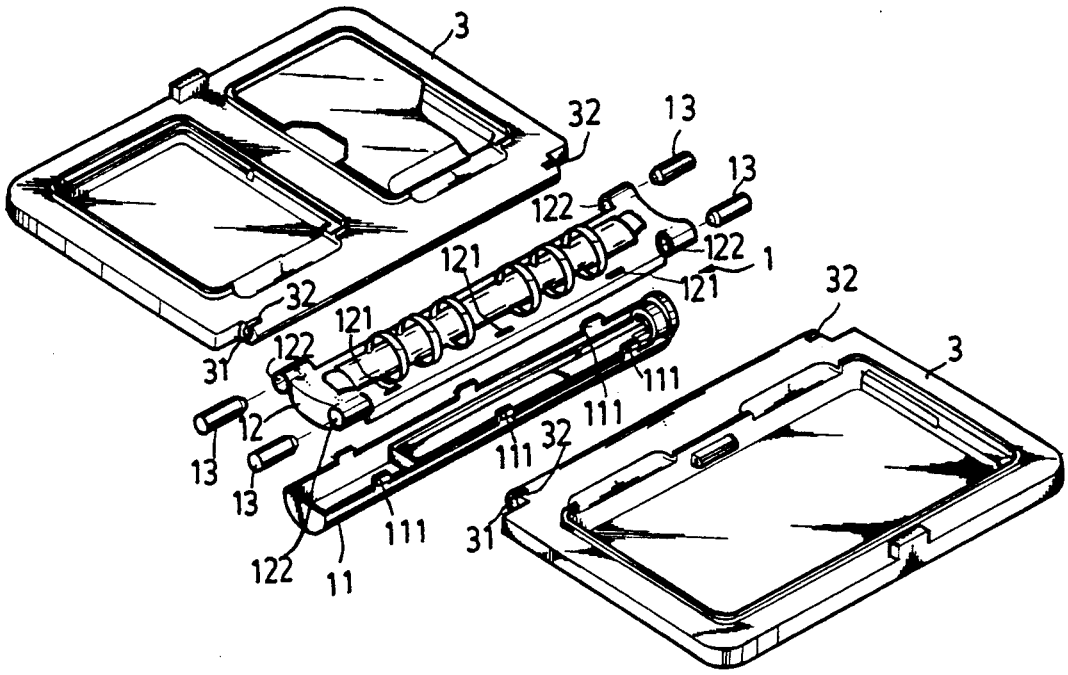
PRIOR ART FIG. 1
FIG. 1 is an exploded view of a book cover hinge assembly according to the prior art.
Figure 2:
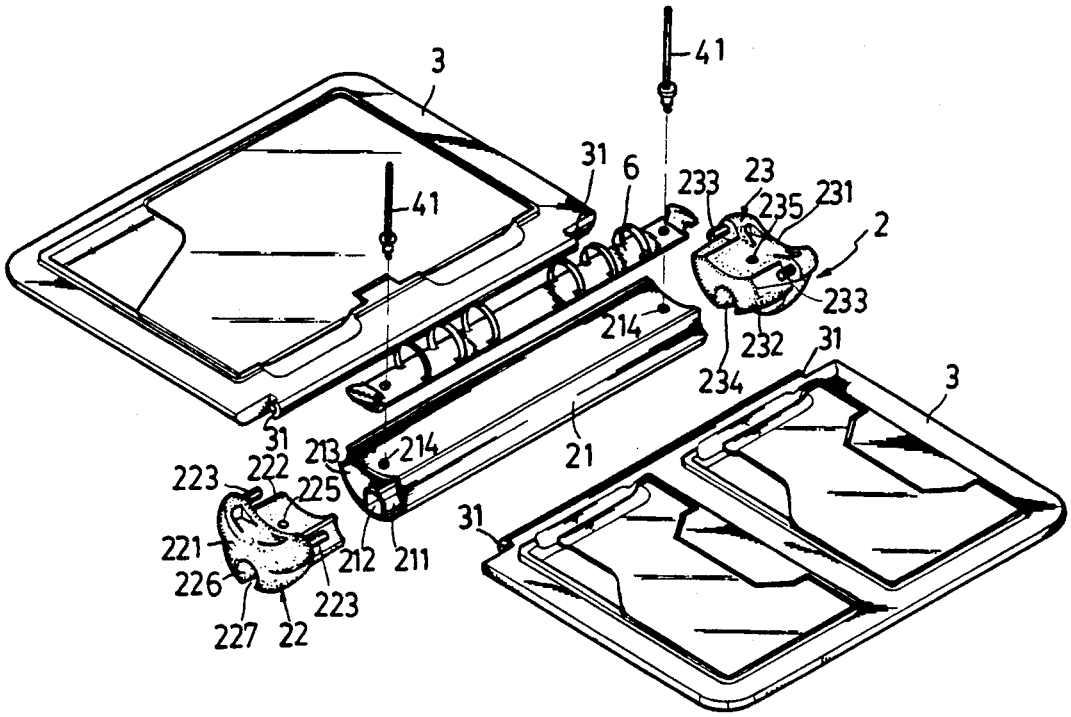
FIG. 2 is an exploded view of a book cover hinge assembly according to the present invention.
Figure 3:
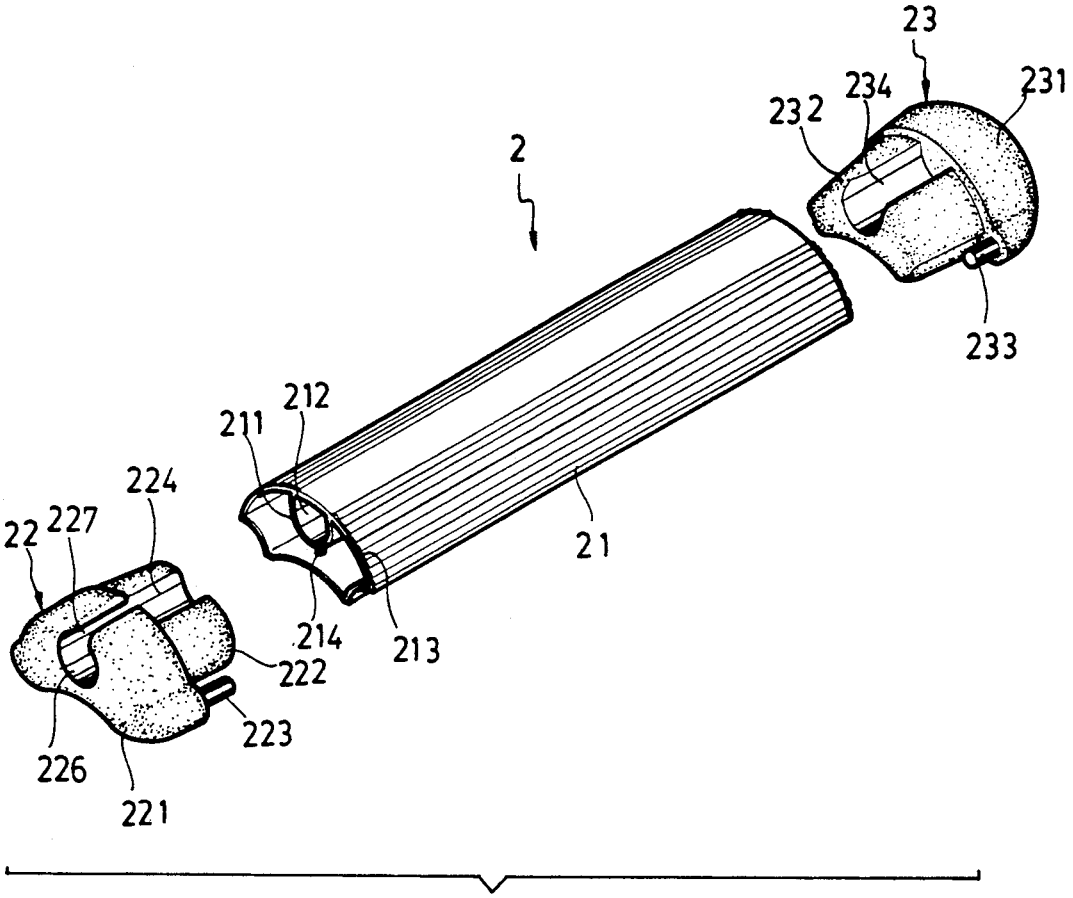
FIG. 3 is an exploded view of the casing of the book cover hinge assembly of FIG. 2.

Referring to FIGS. 2 and 3, a book cover hinge assembly in accordance with the present invention is shown at 2, and generally comprised of a casing 21, a first end connector 22, and a second end connector 23.

The casing 21 is made in the shape of an elongated hollow bar, cut at length according to the book covers 3 to be connected, and having two opposite open ends. The casing 21 comprises a channel plate 211 on the inside defining a storage space 212 with the inside wall 213 thereof for keeping a pen.

The first end connector 22 comprises a head 221 and connecting body 222. The head 221 comprises two pins 223 bilaterally spaced from the connecting body 222 and respectively inserted in a respective pivot hole 31 on either book cover 3, and a longitudinal pen hole 226 with a clip gap 227 aligned with a groove 224 on the connecting body 222. Through the pen hole 226 and the groove 224, a pen can be inserted into the storage space 212 inside the channel plate 211. The clip gap 227 is for passing the clip of the pen being inserted. The groove 224 fits over the outside wall of the channel plate 211 as the connecting body 222 inserted into the corresponding end of the casing 21.

Figure 4:
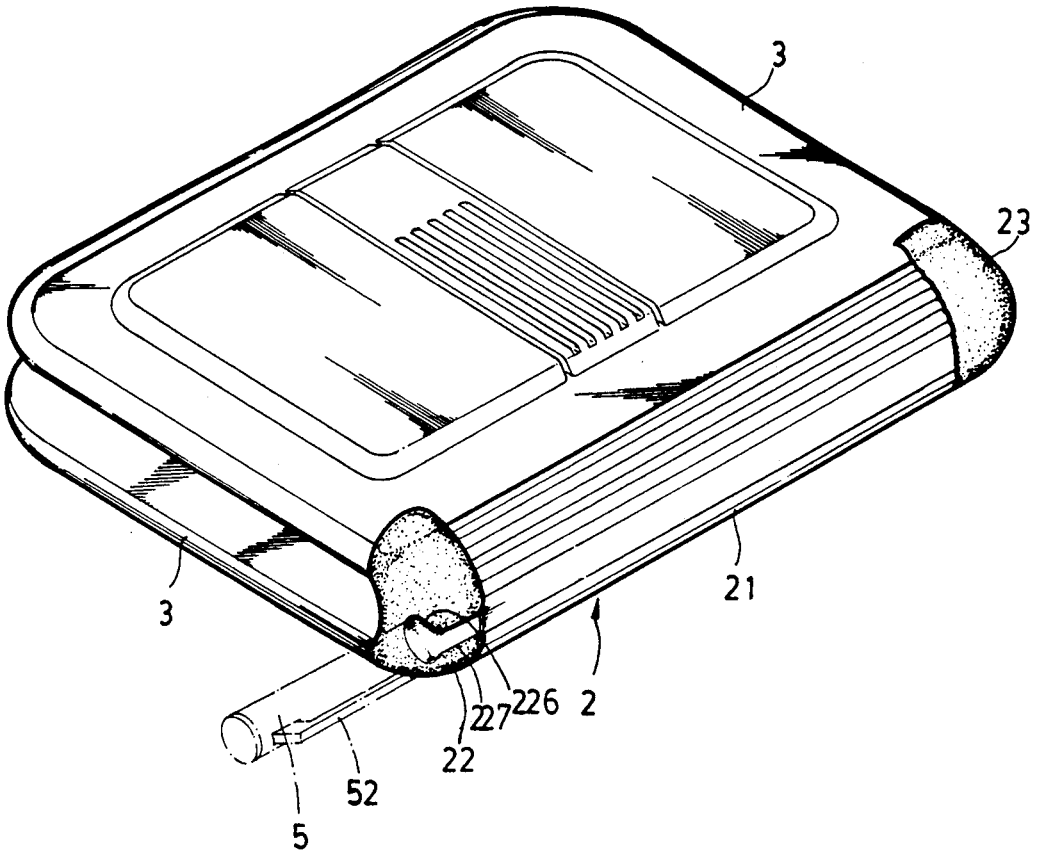
FIG. 4 is a perspective assembly view of the book cover hinge assembly of FIG. 2 showing the covers closed.
Figure 5:
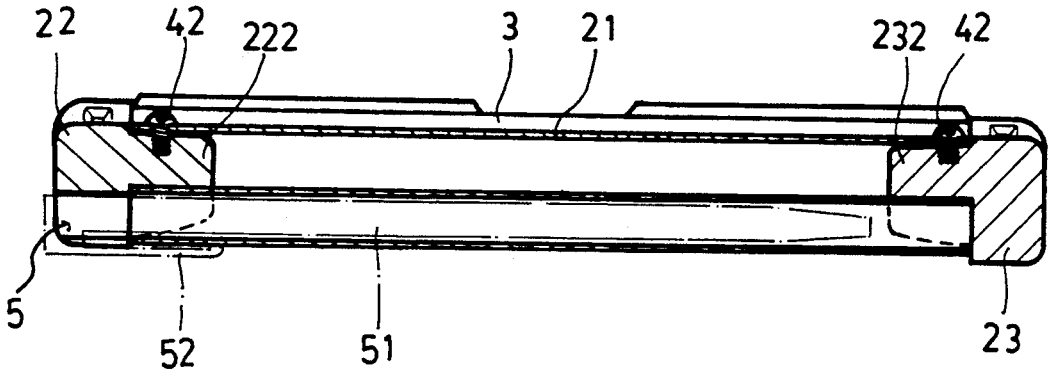
FIG. 5 is a longitudinal sectional view of the casing of the book cover hinge assembly of FIG. 2.

Referring to FIGS. 4 and 5, a pen 5 is inserted through the pen hole 226 with its pen body 51 received inside the storage space 212 and its clip 52 clamped on the peripheral edge of the casing 21.

Referring to FIGS. 2 and 3 again, the second end connector 23 comprises a head 231 and connecting body 232. The head 231 comprises two pins 233 bilaterally spaced from the connecting body 232 and respectively inserted in a respective pivot hole 31 on either book cover 3. The connecting body 232 has a groove 234 fitted over the outside wall of the channel plate 211 as the connecting body 232 inserted into the corresponding end of the casing 21. In general, the second end connector 23 is similar to the first end connector 22, but does not have the pen hole 226 and the clip gap 227.

During the assembly process, the first and second end connectors 22,23 are respectively inserted into either end of the casing 21. Before the connecting body 222 or 232 is being completely inserted into either end the casing 21, the pins 223 of either end connector 22 or 23 are respectively aligned with the corresponding pivot hole 31 on either book cover 3 at either end. Once the connecting body 223 or 233 of either end connector 22 or 23 has been completely inserted into the casing 21, the pins 223 or 233 are also inserted into the respective pivot holes 31 on the two book covers 3. Before inserting into either end of the casing 21, the connecting body 223 or 233 may be covered with a layer of an adhesive agent. After setting of the adhesive agent, the connecting body 223 or 233 becomes firmly secured inside the casing 21.

Referring to FIG. 2 again, the casing 21 has holes 214 at suitable locations and respectively aligned with a respective hole 225 on the connecting body 222 or 232 of either end connector 22 or 23, through which cotter pins 41 are inserted to fasten a loose-leaf clip 6 to the casing 21. Screws 42 may be used in place of the cotter pins 41, and fastened into the holes 214 and 225 to fasten the loose-leaf clip 6, the casing 21 and the end connectors 22 and 23 together (see FIG. 5).

What is claimed is:

1. A book cover hinge assembly comprising:

a) an elongate hollow casing including a pair of opposite open ends and a longitudinal channel plate disposed within the casing for defining a longitudinal storage space therein;

b) a pair of end connectors and a pair of opposed book covers, each book cover including a plurality of pivot holes;

c) each end connector including a head, a connector body extending from the head for insertion within an open end of the casing, plural pins extending from the head and spaced from the connector body for engaging the pivot holes of the book covers, and the connecting body including a longitudinal groove for receiving the longitudinal channel plate.

2. The hinge assembly of claim 1 wherein one of the end connectors includes a passage longitudinally aligned with the groove of the connecting body to define a storage space for receiving a pen, and the passage having a cap formed in a wall thereof for receiving a clip of the pen.

* * * * *